US006116592A

United States Patent [19]

Gunschera

[11] Patent Number: 6,116,592

[45] Date of Patent: Sep. 12, 2000

[54] SHEET CONVEYOR FOR A DELIVERY OF A SHEET-FED PRINTING PRESS

[75] Inventor: Frank Gunschera, Nussloch, Germany

[73] Assignee: Heidelberger Druckmaschinen Aktiengesellschaft, Heidelberg, Germany

[21] Appl. No.: 09/267,294

[22] Filed: Mar. 12, 1999

[30] Foreign Application Priority Data

Mar. 12, 1998 [DE] Germany ..... 198 10 817

[51] Int. Cl.[7] ..... B65H 29/04; B65H 5/02; B65G 25/00; B65G 29/00

[52] U.S. Cl. ..... 271/204; 271/277; 198/803.3; 198/803.7

[58] Field of Search ..... 271/277 C, 204 O; 198/803.3 C, 803.4, 803.5, 803.6, 803.7 C, 803.8, 803.9, 803.1, 851, 644 C

[56] References Cited

U.S. PATENT DOCUMENTS 5,125,640 6/1992 Yerly et al. ..... 271/204

FOREIGN PATENT DOCUMENTS 405270684 10/1993 Japan ..... 271/204
406127843 5/1994 Japan ..... 271/277
0895862 1/1982 U.S.S.R. ..... 271/204
WO
092002442 2/1992 WIPO ..... 271/204

*Primary Examiner*—Christopher P. Ellis
*Assistant Examiner*—Kenneth W Bower
*Attorney, Agent, or Firm*—Herbert L. Lerner; Laurence A. Greenberg; Werner H. Stemer

[57] ABSTRACT

A sheet conveyor for a delivery of a sheet-fed printing press, having at least one operatively revolving gripper bar guidable in a sheet conveying direction along a sheet guiding surface. The gripper bar including grippers having gripper fingers pivotable in a gripper cycle for gripping a sheet respectively conveyable by the gripper bar, is provided with a front spoiler for shielding an intermediate space located between the gripper bar and the sheet guiding surface. The front spoiler being pivotable in a cycle correlated with the gripper cycle and in the same direction as the gripper fingers.

6 Claims, 5 Drawing Sheets

SHEET CONVEYOR FOR A DELIVERY OF A SHEET-FED PRINTING PRESS

BACKGROUND OF THE INVENTION

Field of the Invention

The invention relates to a sheet conveyor for a delivery of a sheet-fed printing press, having at least one operatively revolving gripper bar guidable in a transport direction along a sheet guiding surface, the bar being provided with grippers having gripper fingers pivotable in a gripper cycle for gripping a gripper edge region of a sheet, the edge region being oriented crosswise to the conveying direction, and the sheet being conveyable one at a time by the gripper bar, and also including a front spoiler for shielding an intermediate space located between the gripper bar and the sheet guiding surface. The invention also relates to a delivery equipped with a sheet conveyor, in a sheet-fed printing press.

A sheet conveyor of this general type has become known heretofore, for example, from the published German Patent Document DE 33 08 907 A1, wherein a front spoiler is disposed so that an end thereof facing towards a sheet guiding surface is located relatively close to the free ends of a gripper finger. This is necessary in the case of heretofore known sheet conveyors, for the purpose of preventing a collision between a sheet-guiding cylinder and the front spoiler, when sheets are taken over by the grippers from that sheet-guiding cylinder.

The gripper fingers are pivotable about an axis, located downline from the free ends of the gripper fingers, as viewed in the sheet conveying direction, and disposed in the gripper bar. Consequently, the front spoiler, beginning at the end thereof facing towards the sheet guiding surface, has at least a tendency to rise in an inclined manner, when compared to a normal to the sheet guiding surface, as viewed downline in the sheet conveying direction. With this configuration, the front spoiler acts as an air scoop that, during operation, pushes a turbulent flow ahead of it.

A flowing under of the sheets guided past the sheet guiding surface by the grippers is indeed largely prevented with the heretofore known sheet conveyor, particularly if the front spoiler is formed of elastic material, in which case contact between the sheet guiding surface and the end of the front spoiler facing towards it can be permitted. The turbulent flow pushed in front of the front spoiler, however, is deleterious particularly to the trailing region of a respectively leading sheet. Precisely for this region, however, there is a need for flutter-free travel, to ensure a secure contact of this region with a sheet brake, and thus to permit a sheet, braked to a deposition speed and then released by the sheet brake, as it is lowered onto a sheet pile from a trailing gripper bar and a trailing sheet brought by that gripper bar to the sheet brake, to be transferred in a contact-free overlapping manner.

SUMMARY OF THE INVENTION

It is accordingly an object of the invention to provide a sheet conveyor for a delivery of a sheet-processing printing press wherein a given sheet guided by a gripper bar remains to the greatest extent uninfluenced by factors tending to destabilize the travel thereof, and flow conditions in the surroundings of the gripper bar guiding the sheet are to the greatest extent without influence upon a leading sheet.

With the foregoing and other objects in view, there is provided, in accordance with one aspect of the invention, a sheet conveyor for a delivery of a sheet-fed printing press, having at least one operatively revolving gripper bar guidable in a sheet conveying direction along a sheet guiding surface, the gripper bar including grippers having gripper fingers pivotable in a gripper cycle for gripping a sheet respectively conveyable by the gripper bar, comprising a front spoiler for shielding an intermediate space located between the gripper bar and the sheet guiding surface, the front spoiler being pivotable in a cycle correlated with the gripper cycle and in the same direction as the gripper fingers.

In accordance with another feature of the invention, the front spoiler and a wall of the gripper bar disposed in front and downline of the front spoiler, as viewed in the sheet conveying direction, together form a flow conduit for air flowing through the gripper bar, the flow conduit tending in a direction counter to the sheet conveying direction.

In accordance with a further feature of the invention, the flow conduit, as viewed in a location of the gripper bar as it passes the sheet guiding surface, has an outlet cross section located on a side of the gripper bar distal or remote from the sheet guiding surface.

In accordance with an added feature of the invention, the wall is embodied as a guide vane.

In accordance with an additional feature of the invention, the wall embodied as a guide vane has a cross section with a convex outer contour formed on a side of the wall distal from the flow conduit.

In accordance with a concomitant aspect of the invention, there is provided a delivery for a sheet-fed rotary printing press, comprising a sheet conveyor having at least some of the foregoing features.

Thus, an important feature of the invention is that the front spoiler is pivotable, in a cycle correlated with the gripper cycle, in the same direction as that of the gripper fingers. This creates the possibility of constructing the front spoiler so that the end thereof facing towards the sheet guiding surface can be disposed at a sufficient distance from the free end of the gripper fingers downline of the latter in the sheet conveying direction, and the front spoiler can be given a streamlined contour, so that, around this contour, there is a flow free of any eddy or turbulence developing upstream or upline of the gripper bar. This possibility is attained because, with the pivoting of the front spoiler in the same direction as the pivoting of the gripper fingers and in correlation with the gripper cycle, a collision of the front spoiler with a sheet-guiding cylinder, during the takeover by the grippers of sheets from this cylinder, can be prevented.

Other features which are considered as characteristic for the invention are set forth in the appended claims.

Although the invention is illustrated and described herein as embodied in a sheet conveyor for a delivery of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
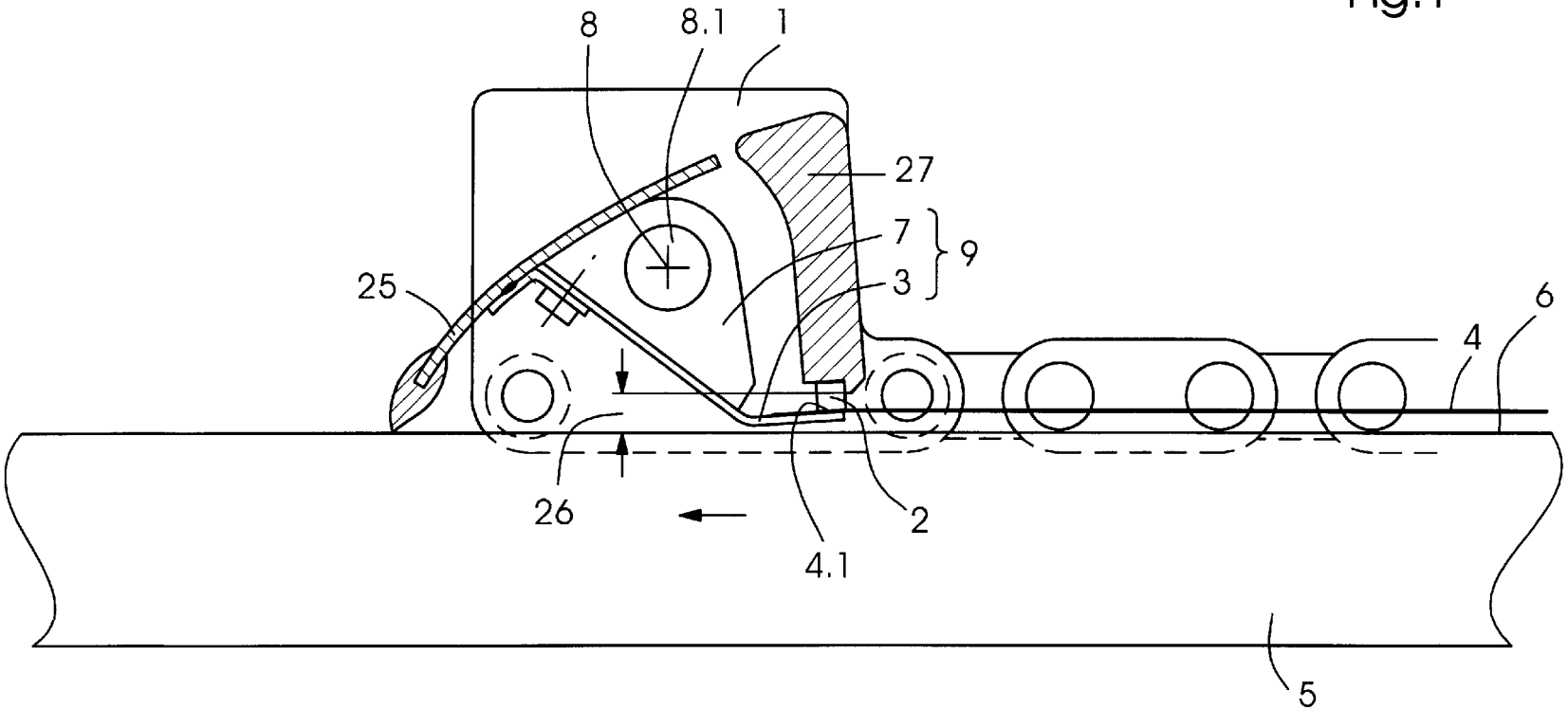
FIG. 1 is a diagrammatic sectional view, taken in a sheet conveying direction, of an exemplary embodiment of a gripper bar for guiding a sheet in the conveying direction via a sheet guiding surface, the gripper bar being in a position wherein it is passing the sheet guiding surface.
Figure 5:
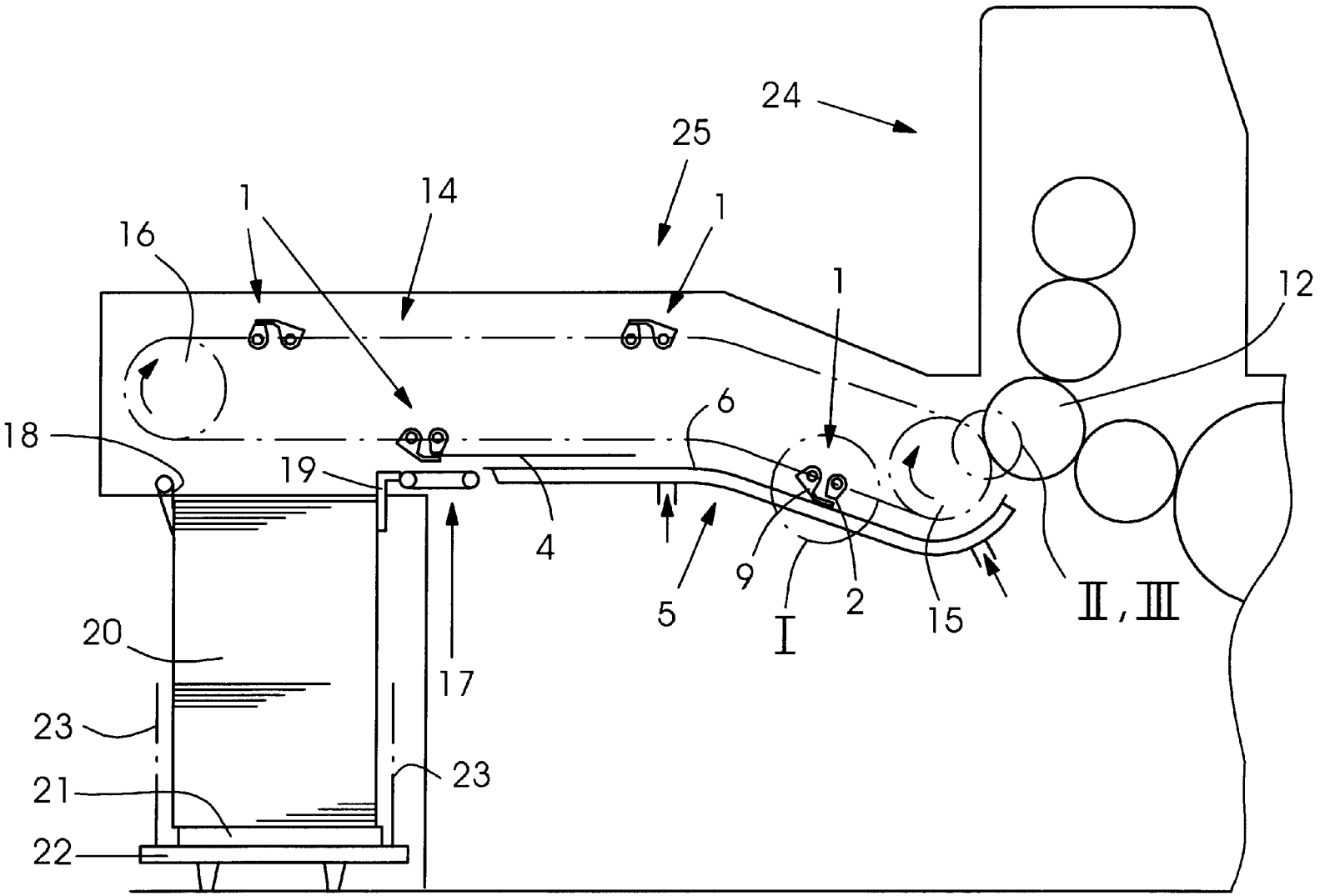
FIG. 5 is a fragmentary diagrammatic side elevational view of a sheet-fed printing press including a delivery equipped with a sheet conveyer according to the invention.

Referring now to the drawing and, first, particularly to FIG. 1 thereof, which is an enlarged view of a detail I of FIG. 5 illustrating a gripper bar 1 of a sheet conveyor according to the invention, there is shown in FIG. 1, in a position corresponding to that of this detail of the gripper bar 1, the sheet conveyor conveying a sheet 4, that is held between gripper pads 2 of the gripper bar 1 and respective free ends of gripper fingers or fingers 3, in a sheet conveying direction represented by the associated horizontal arrow, via a sheet guiding surface 6 formed on a sheet guiding device 5. The respective sheet 4 is held in a gripper edge region 4.1 thereof, that is oriented crosswise to the sheet conveying direction. A respective gripper finger 3 is firmly connected to a gripper base body 7 that is pivotable with respect to a geometric axis 8 that is oriented crosswise to the conveying direction and is parallel to the sheet guiding surface 6, the geometric axis 8 being the axis of a gripper shaft 8.1 provided in the gripper bar 1. The force required to tauten the sheet 4 is furnished by non-illustrated springs, which thus keep the gripper fingers 3 in a pivoted position wherein the grippers 9, each formed by one gripper finger 3 and one gripper base body 7, are closed.

Figure 3:
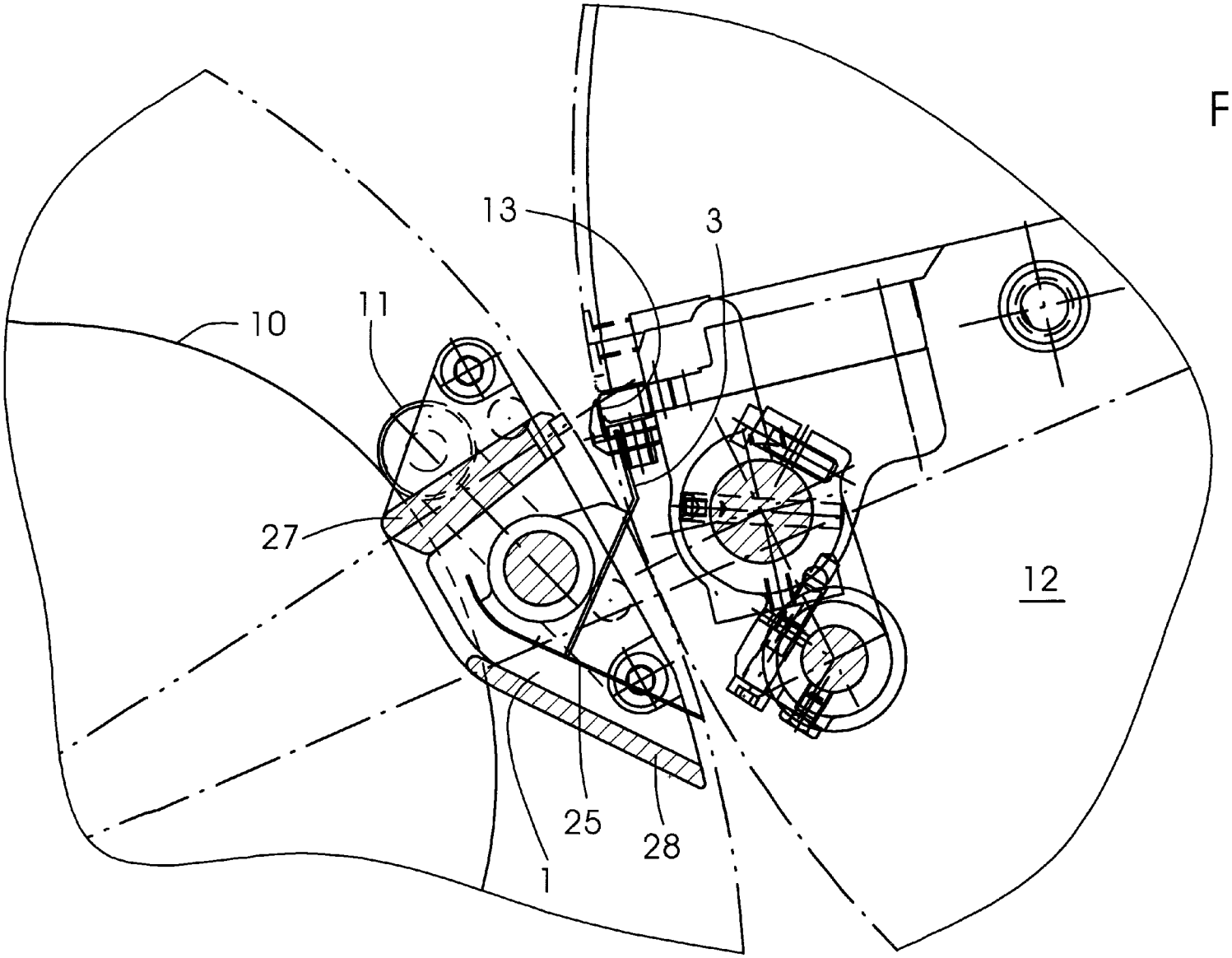
FIG. 3 is a cross-sectional view of a gripper bar similar to that of FIG. 2, in a position just before a sheet is taken over thereby from a sheet-guiding cylinder.
Figure 4:
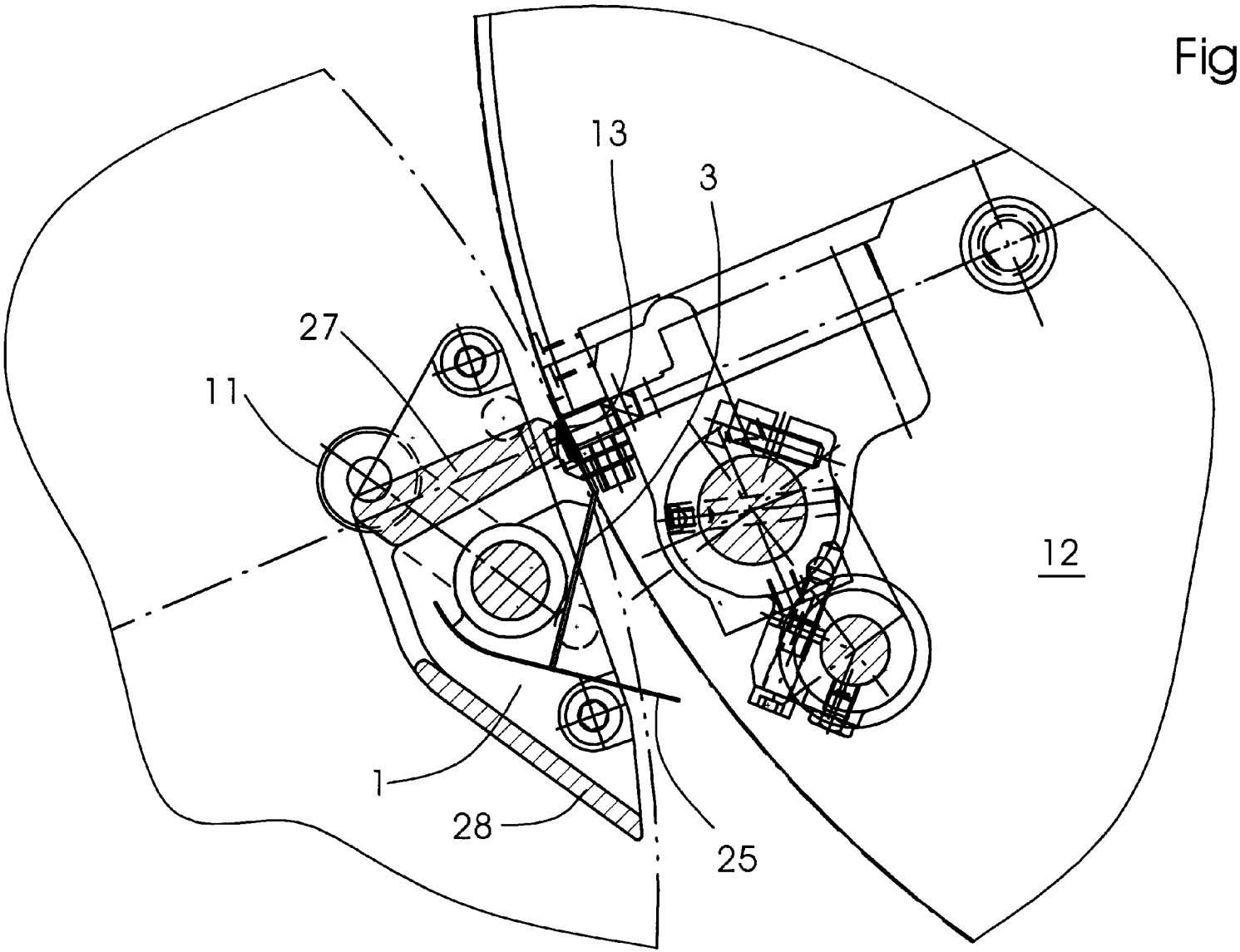
FIG. 4 is a cross-sectional view of the gripper bar of FIG. 3, in a position wherein a sheet is being taken over thereby from a sheet-guiding cylinder.

To pivot the grippers 9 into an opened pivoted position thereof, there is provided a roller lever 11, represented in FIGS. 3 and 4, which act in a conventional manner on the grippers 9 and which are controlled by a gripper control cam 10. The gripper control cam 10 is so disposed and formed that the grippers 9, just before a respective sheet 4 is taken over by a sheet-guiding cylinder 12, as shown in FIGS. 3 to 5, are pivoted into a position wherein the gripper fingers 3 are raised away from the gripper pads 2, and from that time on, wherein the gripper pads 2 have moved to between corresponding gripper pads 13 on the sheet-guiding cylinder 12, assume a pivoted position, under the influence of the aforementioned springs, wherein the sheet 4, guided until that time by the sheet-guiding cylinder 12, is held between the gripper supports 2 and the gripper fingers 3.

The assumption of these pivoted positions of the gripper fingers 3 takes place during a gripper cycle that is determined by the speed of sheet conveyance, and is released or tripped by a revolution, during operation, of the indicated gripper bars 1 as shown in FIG. 5; for the purposes of this revolution the gripper bridges are coupled to an endless chain conveyor 14 of a delivery, represented in phantom or by dot-dash lines in FIG. 5, that revolves during operation in the directions resulting from the rotation of a driving chain or sprocket wheel assembly 15 and a deflection or reversing chain wheel or sprocket assembly 16, as indicated by the curved arrows in FIG. 5.

The endless chain conveyor 14 includes the driving chain wheel assembly 15 and the deflection chain wheel assembly 16 and guides a respective gripper bar 1 in a manner that the gripper pads 2 during operation move, in particular, to between the gripper supports 13 on the sheet-guiding cylinder 12. The gripper control cam 10 that is responsible for the opening and closing of the grippers 9 for the purpose of transferring a respective sheet 4 from the sheet-guiding cylinder 12 to the sheet conveyer is assigned to the driving chain wheel assembly 15 that follows the sheet-guiding cylinder 12. The sheet-guiding cylinder 12 is part of a final processing station of the printing press and can, in this sense, be a component of a printing unit or of a finishing unit, such as a varnishing unit. In the exemplary embodiment shown in FIG. 5, a final processing station is a printing unit 24 operating by the offset method.

The deflection chain wheel assembly 16 is also assigned to a gripper control cam, not shown in FIG. 5, that cooperates with the roller lever 11 of a respective gripper bar 1. This cam also produces a temporary pivoting of the gripper fingers 3 into an open position thereof, so that a respective sheet 4 that has entered the operational range of a sheet brake 17 is transferred to this brake 17, is braked thereby to deposition speed, and finally released, whereupon it moves, as it is simultaneously being lowered, towards leading-edge or front stops 18 and, while being aligned to these stops 18 and to trailing-edge stops 19 disposed opposite thereto, forms a sheet pile 20, together with preceding and/or trailing sheets 4, on a pile support 21 that can be lowered by a reciprocating mechanism to the same extent as the height of the pile 20 increases. All that can be seen of the reciprocating mechanism in FIG. 5 are a platform 22 and reciprocating chains 23 supporting it as indicated in phantom or by dot-dash lines.

In FIG. 5, the gripper bars 5 are represented diagrammatically and merely symbolized by grippers 9 and gripper pads 2 assigned thereto.

As is apparent from FIGS. 1 to 4, however, a respective gripper bar 1 also includes a front spoiler 25, by which an intervening space 26 located between the gripper bar 1 and the sheet guiding surface 6 can be shielded. The front spoiler 25 is pivotable in the same direction as the gripper fingers 3 and in a cycle correlated with the gripper cycle.

To realize this construction, the following, for example, are provided: fastening of the front spoiler 25 to retainers, which are supported on the gripper shaft 8.1 and are pivotable relative to the geometric axis 8 thereof through a given angle between a first pivoted position wherein the intervening space 26 is shielded and a second pivoted position moved away from the sheet guiding surface 6; a spring assembly, by which the front spoiler 25 is prestressed in the same pivoting direction as that of the grippers 9 by the spring assembly acting thereon; a roller lever by which the front spoiler 25 is pivotable counter to the action of the spring assembly prestressing it; and a spoiler control cam that cooperates with the aforementioned roller lever and is so arranged and constructed that the front spoiler 25 assumes the second pivoted position thereof, as shown in FIG. 3, at least primarily whenever the gripper fingers 3 of the grippers 9 of the gripper bar 1 approaching the sheet-guiding cylinder 12 assume the pivoted position thereof wherein they are lifted away from the gripper pads 2, and the front spoiler 25 assumes the first pivoted position thereof, as shown in FIG. 4, simultaneously with or following the transfer of a sheet 4 from the sheet-guiding cylinder 12. The spoiler control cam is assigned to the driving chain wheel assembly 15 and, in particular, controls thereat the pivoting of the front spoiler 25 into the second pivoted position thereof that is provided for preventing a collision of the front spoiler 25 with the sheet-guiding cylinder 12.

As mentioned hereinbefore, the deflection chain wheel assembly 15 has a gripper control cam also assigned thereto that cooperates with the roller lever 11 of a respective gripper bar 1; this cam temporarily opens the grippers 9 during operation, by suitably pivoting the gripper fingers 3 thereof. Because, within range of the deflection chain wheel assembly 16, there is no sheet-guiding cylinder with which the front spoiler 25, located in the first pivoted position thereof, could collide, however, it is possible in this region to dispense with the pivoting of the front spoiler 25 in the same direction as the pivoting of the gripper fingers 3 that occurs thereat. In the exemplary embodiment described thus far, this circumstance is taken into account by providing that there be no spoiler control cam in the region of the deflection chain wheel assembly 16, and so that, during the temporary opening of the grippers 9 for the purpose of transferring a respective sheet 4 to the sheet brake 17, the front spoiler 25 remains in the first pivoted position thereof. This results in a correlation of the cycle with which the front spoiler 25 is pivoted during operation, with the gripper cycle in such a manner that a pivoting of the front spoiler 25 occurring in the same direction as the pivoting of the grippers 9 takes place once during a revolution of a respective gripper bar 1, specifically upon a passing of the sheet-guiding cylinder 12, while pivoting of the gripper fingers 3 out of a first gripper finger pivoted position, corresponding to the state known as "grippers 9 closed" into a second gripper finger pivoted position, corresponding to the state "grippers 9 opened" and an ensuing pivoting of the gripper fingers 3 back into the first pivoted position of the gripper fingers, occurs twice during a revolution of a respective gripper bar 1. The spoiler control cam assigned to the driving chain wheel assembly 15 is moreover disposed and constructed so that the time interval within which the front spoiler 25 of whichever gripper bar 1 passes the sheet-guiding cylinder 12 is in the second pivoted position thereof, that is, the pivoted position wherein the front spoiler 25, on moving past the sheet guiding surface 6, would shield off the intervening space 26 between the latter and the gripper bar 1, in any case encompasses whatever time interval within which the grippers 9 of the particular gripper bar 1 passing the sheet-guiding cylinder 12 are opened.

The angle by which the front spoiler 25 can be pivoted between the two pivoted positions thereof is selected so that in the second pivoted position thereof, the front spoiler 25 passes the sheet-guiding cylinder 12 without collision.

In a second exemplary embodiment, provision is made for the front spoiler 25 of a respective gripper bar 1 to be pivotable together with the gripper fingers 3 of the grippers 9 of this gripper bar 1. As shown in FIG. 1, the front spoiler 25 is, for example, firmly connected to a given number of the gripper base bodies 7 of the gripper bar 1 so that there results therefrom already a pivoting of the front spoiler 25 in the same direction as the pivoting of the gripper fingers 3, the pivoting of the front spoiler 25 being correlated cyclically with the gripper cycle, without requiring an additional pivoting mechanism for the front spoiler 25. There results a correlation of the spoiler cycle, by which the front spoiler 25 is pivoted during operation, with the gripper cycle so that the spoiler cycle and the gripper cycle agree. The front spoiler 25 is indeed unnecessarily pivoted temporarily into the second pivoted position thereof within the range of the deflection chain wheel assembly 16, but in view of the especially simple manner for realizing the intended pivoting of the front spoiler 25, this is acceptable.

In each case, the front spoiler 25 is constructed and disposed so that the grippers 9 of the gripper bar 1 that revolves during operation are located in the lee of the front spoiler 25. The front spoiler 25 has a cross section that, with respect to the grippers 9 of the gripper bar 1, extends downline in the sheet conveying direction. When the gripper bar 1 moves past the sheet guiding surface 6, the front spoiler 25 is in the first pivoted position thereof. The downline end of the cross section of the front spoiler 25 is located at least in the immediate vicinity of the sheet guiding surface 6 and, if there is a rubber-elastic lip on this end, it can even slide on the sheet guiding surface 6. As clearly shown in FIGS. 3 and 4 by the paths of the downline end of the cross section of the front spoiler 25, a collision of the front spoiler with the sheet-guiding cylinder 12 is avoided due to the aforediscussed pivotability of the front spoiler 25. The aforementioned cross section, on the side remote from the sheet guiding surface 6, otherwise has a contour that, viewed in a position of the gripper bar 1 passing the sheet guiding surface 6, extends in an upline direction, in terms of sheet conveyance, from the aforementioned downline end of this cross section, and is formed so that the gripper bar 1 moving past the sheet guiding surface 6 has a flow around it that is markedly free of separations or nonlaminar structure on the side thereof remote from the sheet guiding surface 6.

Figure 2:
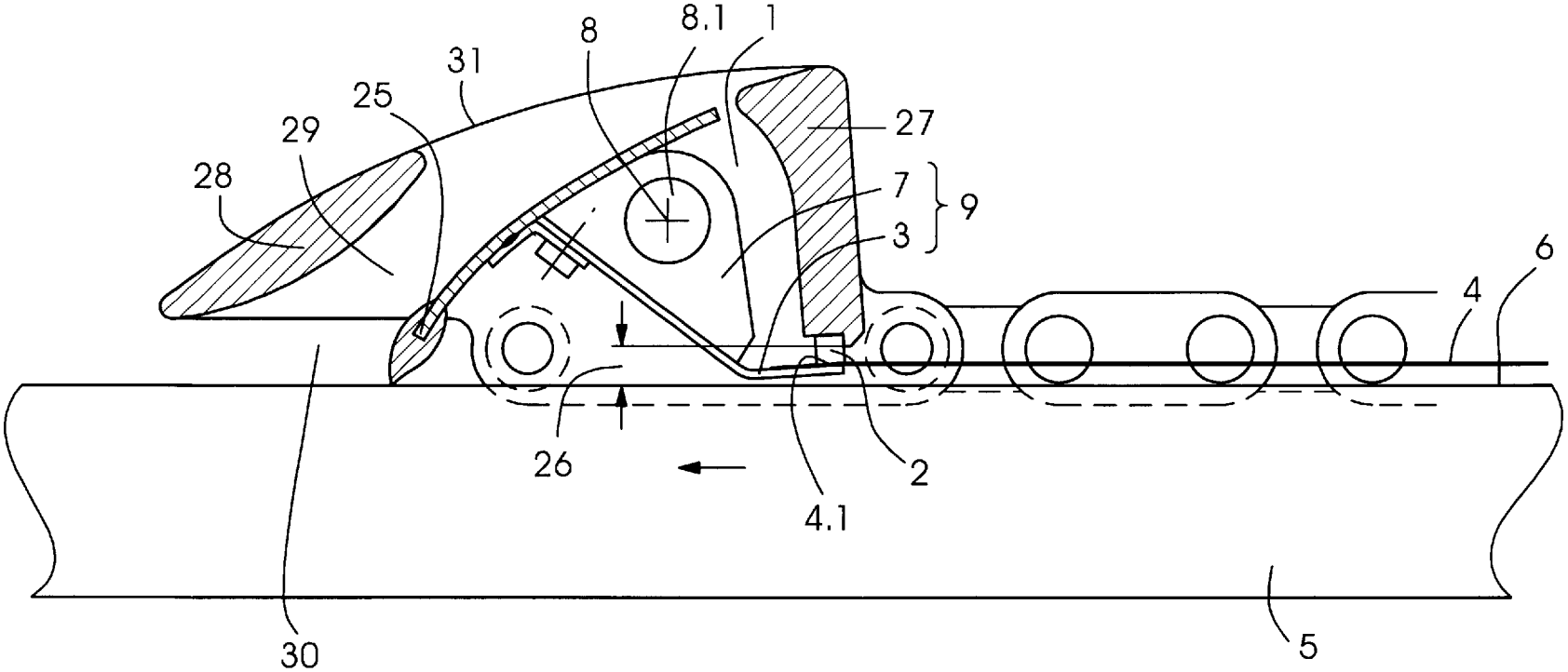
FIG. 2 is a view like that of FIG. 1 of another embodiment of the gripper bar constructed so as to meet increased demands upon the dimensional stability thereof.

Especially when sheets having a large size or format are being conveyed, particular demands are made upon the dimensional stability of the gripper bars 1. As one of the provisions for meeting these demands, the gripper bar 1, as seen in FIG. 2, is provided not only with a first wall 27 that supports the gripper pads 2, but also with a second wall 28, placed in front or downline of the front spoiler 25, as viewed in the sheet conveying direction. Preferably, the second wall 28 and the front spoiler 25, together define a flow conduit 29 for air flowing through the gripper bar 1 and tending to flow counter to the sheet conveying direction.

As is also apparent from FIG. 2, the wall 28 is disposed so that the flow conduit 29, viewed in a position of the gripper bar 1 passing the sheet guiding surface 6, has an inlet cross section 30 facing towards the sheet guiding surface 6 and an outlet cross section 31 that lies on a side of the gripper bar 1 remote from the sheet guiding surface 6. The wall 28 is preferably embodied as a guide vane having a cross section formed with a convex outer contour on a side of the wall 28 remote from the flow conduit 29. The curvature of this outer contour is such that the flow prevailing during operation in the flow conduit 29 is united, to the greatest extent without disruption, with a flow in the outlet cross section 31 that sweeps over the wall 28 that is embodied as a guide vane.

I claim:

1. A sheet conveyor for a delivery of a sheet-fed printing press, having at least one operatively revolving gripper bar guidable in a sheet conveying direction along a sheet guiding surface, the gripper bar including grippers having gripper fingers pivotable in a gripper cycle for gripping a sheet respectively conveyable by the gripper bar, comprising a front spoiler for shielding an intermediate space located between the gripper bar and the sheet guiding surface, said front spoiler being pivotable in a cycle correlated with the gripper cycle and in the same direction as the gripper fingers.

2. The sheet conveyor according to claim 1, wherein the front spoiler and a wall of the gripper bar disposed in front and downline of the front spoiler, as viewed in the sheet conveying direction, together form a flow conduit for air flowing through the gripper bar, said flow conduit tending in a direction counter to the sheet conveying direction.

3. The sheet conveyor according to claim 2, wherein said flow conduit, as viewed in a location of the gripper bar as it passes the sheet guiding surface, has an outlet cross section located on a side of the gripper bar distal from the sheet guiding surface.

4. The sheet conveyor according to claim 2, wherein said wall is embodied as a guide vane.

5. The sheet conveyor according to claim 4, wherein said wall embodied as a guide vane has a cross section with a convex outer contour formed on a side of said wall distal from said flow conduit.

6. A delivery for a sheet-fed rotary printing press, comprising a sheet conveyor according to claim 1.

* * * * *